US006024015A

United States Patent [19]

Dillig et al.

[11] Patent Number: 6,024,015

[45] Date of Patent: Feb. 15, 2000

[54] INKING DEVICE FOR A ROTARY PRINTING MACHINE

[75] Inventors: Peer Dillig, Wulfertshausen; Wolfgang Schönberger, Neusäss, both of Germany

[73] Assignee: MAN Roland Druckmaschinen AG, Offenbach am Main, Germany

[21] Appl. No.: 09/067,058

[22] Filed: Apr. 27, 1998

[30] Foreign Application Priority Data

Apr. 26, 1997 [DE] Germany ..... 197 17 727

[51] Int. Cl.[7] ..... B41F 31/04; B41F 31/06; B41F 31/08

[52] U.S. Cl. ..... 101/350.5; 101/350.6

[58] Field of Search ..... 101/350.1, 350.2, 101/350.4, 350.5, 350.6, 351.1, 351.8, 364, 363, 365, 366, 207–210, 148; 118/261, 259, 258, 262

[56] References Cited

U.S. PATENT DOCUMENTS

| | | | |
|---|---|---|---|
| 3,780,651 | 12/1973 | Black et al. | 101/115 |
| 5,596,351 | 1/1997 | Stapleton | 347/7 |
| 5,842,416 | 12/1998 | Olawsky et al. | 101/350.1 |

FOREIGN PATENT DOCUMENTS

| | | |
|---|---|---|
| 0 286 305 | 10/1988 | European Pat. Off. . |
| 0 359 955 | 8/1989 | European Pat. Off. . |
| 0 513 546 A1 | 11/1992 | European Pat. Off. . |
| 28 11 276 C2 | 9/1979 | Germany . |
| 33 26 228 A1 | 3/1984 | Germany . |
| 38 00 412 A1 | 7/1989 | Germany . |
| 38 32 148 A1 | 4/1990 | Germany . |
| 39 11 839 A1 | 10/1990 | Germany . |
| 42 39 808 A1 | 6/1993 | Germany . |
| 42 41 792 A1 | 6/1994 | Germany . |
| 44 01 299 A1 | 7/1995 | Germany . |
| 61-133363 | 8/1986 | Japan . |
| 64-34740 | 2/1989 | Japan . |
| 2-113944 | 4/1990 | Japan . |
| 8-216371 | 8/1996 | Japan . |

*Primary Examiner*—J. Reed Fisher
*Attorney, Agent, or Firm*—Cohen, Pontani, Lieberman, Pavane

[57] ABSTRACT

An inking device for inking a screen roller of a printing machine includes an ink supply device with an ink reservoir that are removable as one unit from the printing machine easily and without tools. The ink reservoir is separable from the ink supply device. The ink reservoir is filled using an ink cartridge. The printing ink is conveyed under pressure from the ink reservoir to the ink supply device in a supply line. The ink is pressed into the cups or hatchings of the inking device roller via the supply line by using a pump or a conveying roller.

16 Claims, 2 Drawing Sheets

100
1
2
3
4
5
6
7
7a
7b
8
9
10
11
12
13
14
15
16
17
18
19
20
25
26
27
30
31
70
P 100
1
15
23
22
14
13
24
21
P
4
18
19
5
3
31
6
20
7a
7b
7
70
8

INKING DEVICE FOR A ROTARY PRINTING MACHINE

BACKGROUND OF THE INVENTION

1. Field of the Invention

The invention relates to an inking device for a rotary printing machine with a screen roller having an ink supply device arranged on the screen roller. The ink supply device is sealed by blades positioned parallel to a longitudinal axis of the screen roller. The ink supply device supplies printing ink to the circumferential surface of the screen roller and carries away ink that is unabsorbed by or wiped away from the screen roller.

2. Description of the Related Art

A prior art rinsing inking device for a rotary printing machine is disclosed in German reference DE 39 11 839 A1. The prior art rinsing inking device interacts with a screen roller. A closed chamber is arranged below the screen roller bounded by blades on both sides on a circumferential surface of the screen roller. A supply device positioned between the two blades inside the chamber for supplying printing ink under a slight overpressure in an ink application channel. The edges of the supply device bordering the screen roller are separated from the screen roller on both sides. Printing ink that is not pressed from the ink application strip into cups of the screen roller and that drips on the outside of the ink application channel, is conveyed under overpressure to an ink tank by a suction device.

A disadvantage of the inking device known from DE 39 11 839 A1 is that ink supplied from the ink application channel but not absorbed by the cups of the screen roller is not fed back to the ink supply system and is lost.

A prior art distribution device for printing ink is disclosed in German reference DE 33 26 228 A1. The distribution device includes an ink tank forming an air-tight seal connected to a line, from which printing ink is sprayed under pressure onto inking device rollers. The pressure is produced by a pressurized air source that is connected to the ink tank. A prefabricated cartridge containing the printing ink is insertable in the interior of the tank.

The disadvantage of this ink supply system is that it is open. When the ink is sprayed out, not only are the inking device rollers inked, but the surrounding environment is contaminated as well. This necessitates expensive cleaning and a high consumption of cleaning agents. Changing the ink takes a correspondingly long time, and a large amount of ink is lost during the ink change process.

SUMMARY OF THE INVENTION

The object of the invention is to provide an improved inking device of the aforementioned type such that no printing ink is lost during the inking process and that ink changes may be carried out simply and ergonomically.

This object is attained by an inking device having an ink supply portion which supplies printing ink to a screen roller and includes an ink return portion which gathers the ink that is applied to the screen roller but not absorbed by the screen roller. The ink supply portion and ink return portion comprise a closed system.

The present invention includes a closed system for supplying printing ink to the screen roller that minimizes contamination of the ink by paper dust, washing agents and the like. Ink changes are made easier by the fact that the ink reservoir for the printing ink is designed to be exchangeable. Preferably, there is also an exchangeable cartridge for the printing ink. Cartridges of this type are manually removable by an operator of the printing machine for quick and simple removal without requiring any special tools. Because the volume of the ink supply lines is very low compared to the volume of the ink reservoir and thus, preferably, the volume of the cartridge, only a very small amount of printing ink is lost during an ink change. In addition, there is no loss of printing ink during printing operations because ink that is supplied by the supply line and not absorbed by the screen roller remains inside the closed ink supply system and is recycled. The low volume of the supply lines also results in lower consumption of cleansing agents and solvents. The invention enables ink changes to be carried out quickly and without contamination. Because of the low volume of ink in circulation, the invention also provides an environmentally-friendly and resource-conserving process for inking a printing roller that is simple to clean and which is easily and ergonomically handled.

To facilitate manual handling, the cartridges are designed to be light-weight and thus easy to change. The low volume of ink in circulation volume permits an accurate determination of the fill level with a constant ink supply. If a wetting agent is used, the accurate determination of fill level also ensures a constant ink-water balance at all times.

A farther advantage of the inking device according to the invention is that at least one of the pressure under which the printing ink stands in the ink supply device is measured or the fill level of the ink is measured. In either case, a uniform and continuous supply of ink is ensured. The ink filling process inside the inking device is thus monitored and regulated.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
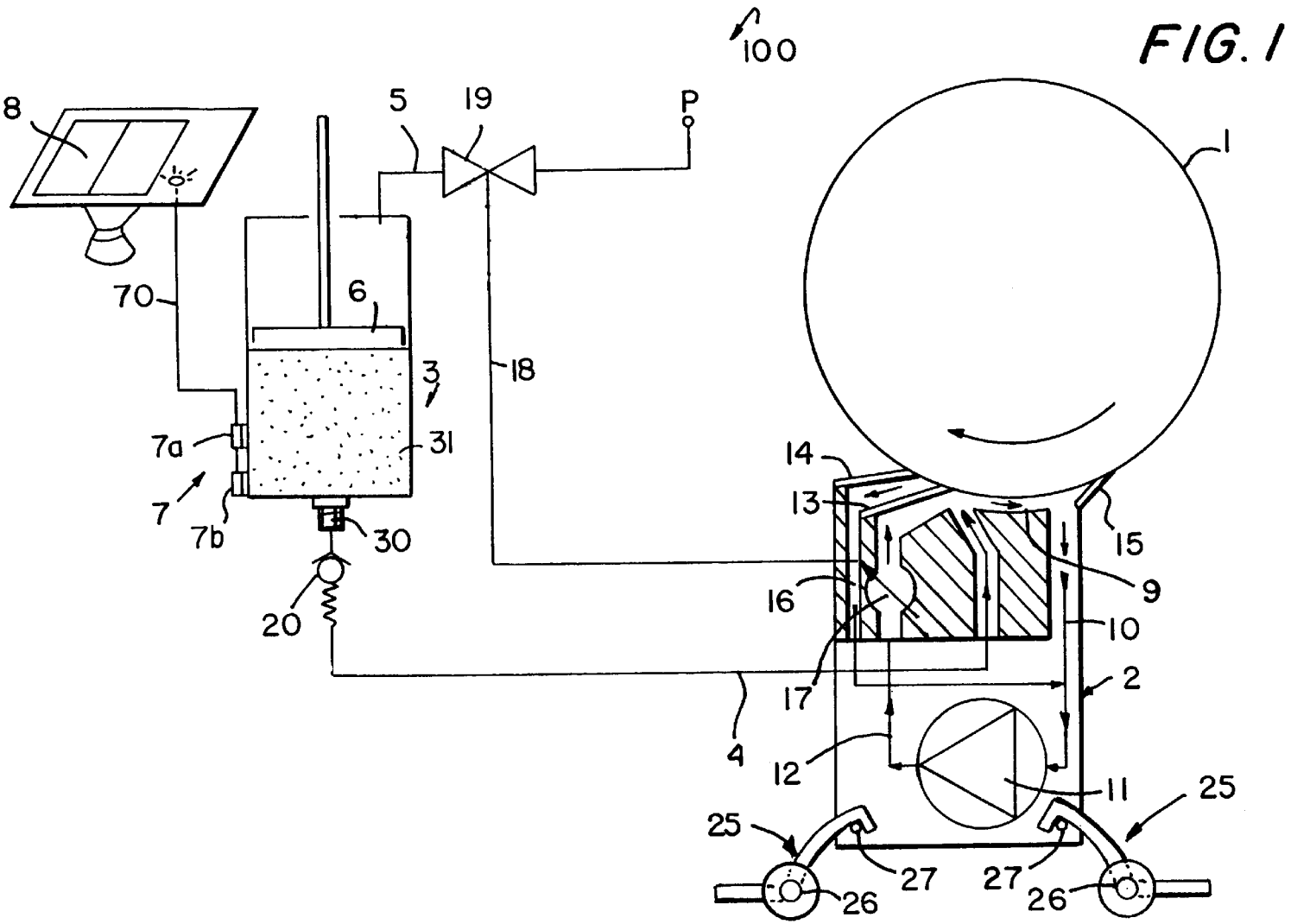
FIG. 1 is a schematic diagram of an ink supply device in accordance with an embodiment of the present invention.

Referring initially to FIG. 1, an inking device 100 for a printing machine (not shown) includes a roller 1 that is inked by an ink supply device 2. The roller 1 comprises a screen roller with cups or hatchings and belongs to a short inking unit. In the preferred embodiment, the roller 1 rotates at machine speed of the printing machine in which the inking device is mounted (machine speed is determined by the speed of a form cylinder of the printing machine (not shown)). The width of the ink supply device 2 is preferably the same as the width of the printing stock web. However, if the printing web is 4-pages wide, the ink supply device 2 may also be 1-page wide or 2-pages wide. Ink supply devices 2 of different page widths are thereby interchangeable with each other. The ink supply device 2 is supplied with printing ink from an ink reservoir 3 via a supply line 4. The ink reservoir 3 preferably has a manually exchangeable ink cartridge 31. The ink reservoir 3 may be directly attached to the ink supply device 2, preferably by an easily detachable connection, such, for example, as a bayonet lock, a snap lock, or a screw lock 30. In the embodiment shown, the ink reservoir 3 is connected to the supply line 4 via the screw lock 30 which is quickly detachable whenever an exchange of the reservoir 3 is required. The ink reservoir 3 includes a cylinder that is pneumatically or hydraulically operated by a pressurized medium P supplied through a pressure line 5. The piston 6 of the cylinder serves to press printing ink into the supply line 4.

A level monitor 7 is attached to the ink reservoir 3. When a level 7*a* and a level 7*b* are reached, the level monitor transmits suitable signals via a signal line 70 to a control panel 8 of the printing machine. The control panel 8 displays the information to ensure that the operating personnel are kept aware of the ink level and can anticipate when the ink reservoir 3 will become empty.

When the ink reservoir 3 as a whole is removed from the printing machine, the connection (e.g., the screw lock 30) between the ink reservoir 3 and the ink supply line 4 is detached. At the same time, the connections for the pressure line 5 and the signal line 70 are also detached. The ink reservoir 3 contains ink cartridge 31 that is exchangeable in a known manner and is easily removable from the ink reservoir 3 without the use of tools. A quick-release coupling, such, for example, as a bayonet lock may be used to connect the cartridge 31 to the ink reservoir 3. The ink reservoir 3 may also be removed from the printing machine together with the ink supply device 2.

Newly-supplied printing ink is brought into the cups or hatchings of the roller 1 via the supply line 4 under pressure. The portion of printing ink that is not absorbed by the cups passes through a gap 9 that runs between the circumferential surface of the roller 1 and the inking device 2. The direction in which the ink flows through the gap 9 is thereby opposite to the rotational direction of the roller 1, so that the cups for the printing ink attain a good absorption capacity. The ink that is not absorbed by the cups is conveyed through a feedback line 10 to a suction pump 11 to be recycled. The suction pump 11 pumps the recycled ink through another supply line 12 which directs the recycled ink back to the circumferential surface of the inking device roller 1. The supply line 12 opens at the same position on the surface of roller 1 as the supply line 4. This measure facilitates the rapid filling of the cups or hatchings of the roller 1.

In addition to the expeditious filling of the cups or hatchings, ink loss from the closed system of the ink supply device 2 of the ink reservoir 3 is also prevented during the inking process. The ink supply device 2 is hermetically sealed relative to the roller 1 by a working pre-blade 13, a working blade 14 and a closing blade 15. Between the working pre-blade 13 and the working blade 14, printing ink that overflows from the circumferential surface of the inking device roller 1 is also fed back via a feedback line 16, which opens into the feedback line 10, to the suction pump 11.

The supply line 12 includes an optional pressure monitor 17 which measures the pressure at which the printing ink is applied to the inking device roller 1. Alternatively, a fill level monitor may also be provided. The pressure monitor 17 or the fill level monitor may work on an optical, capacitative, electrical, magnetic or acoustical principle. When the pressure monitor 17 senses a pressure below a target level, the pressure monitor 17 transmits a signal through a signal line 18 to a valve 19 located in the pressure line 5. The valve 19 is opened, so that the pressurized medium will flow through the pressure line 5 into the piston-cylinder unit 6 to increase the pressure applied to the printing ink in the ink reservoir 3. A non-return valve 20 in the supply line 4 prevents the printing ink from flowing back into the ink reservoir 3 if the pressure in the supply line 4 ever exceeds the pressure in the ink reservoir 3.

The inking device 100 provides a continuous and uniform supply of printing ink to the circumferential surface of the inking device roller 1. Therefore, a uniform inking of the roller 1 is ensured.

As mentioned above, the ink supply device 2 is also easily removed from the printing machines during required ink changes. To this end, quick release lock, in the form of turn handles 25 are used, which are mounted about pivot points 26 inside the printing machine and secure the ink supply device 2 on bolts 27.

Figure 2:
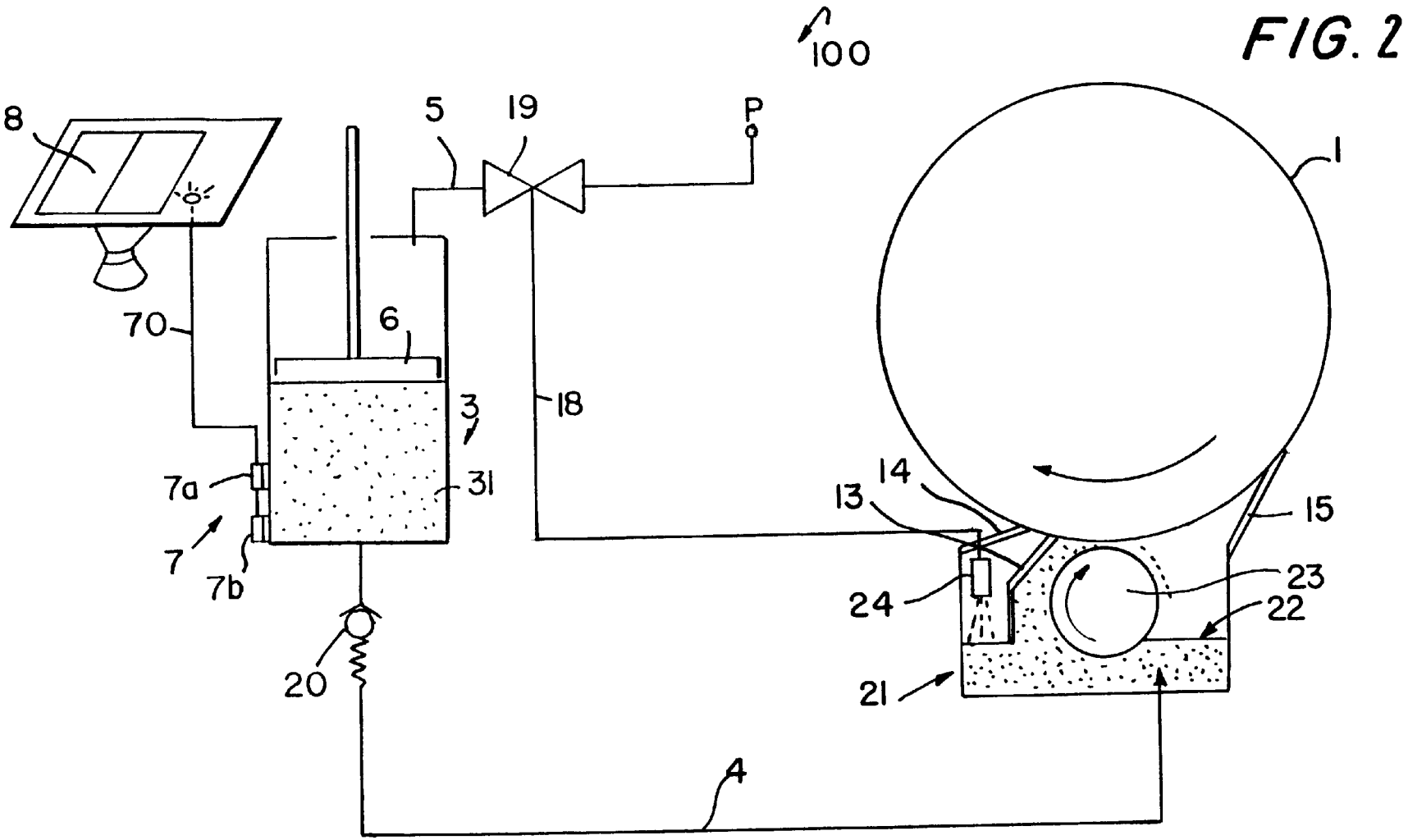
FIG. 2 is a schematic diagram of an ink supply device in accordance with another embodiment of the present invention.

Referring now to the embodiment shown in FIG. 2, another ink supply device 21, like the ink supply device 2, is supplied with printing ink from an ink reservoir 3 and inks the inking device roller 1. Like the ink supply device 2, the ink supply device 21 has a working pre-blade 13, a working blade 14 and a closing blade 15. The working blade 14 is embodied either positively or negatively (as shown in FIGS. 1 and 2). The closing blade 15 is embodied either touching or not touching the inking device roller 1, and may also be positioned either positively or negatively. The closing blade 15 is preferably embodies in a non-touching manner so that if any printing ink remains on the connecting pieces between the cups or hatchings of the roller 1 after one rotation, no printing ink will drip down laterally on the ink supply device 2. A cavity inside the ink supply device 21 is filled with printing ink to a predetermined level by the ink supply line 4. A conveying roller 23 located within the ink supply device 21 rotates opposite to the rotational direction of the roller 1 and transports the printing ink to the circumferential surface of the ink roller 1 None of the absorbed printing ink is fed back to the ink supply inside the ink supply device 21, so that this example, too, has a closed ink supply system. The conveying roller 23 serves both to supply printing ink to the cups or hatchings of the screen roller 1 and to carry away printing ink that is not absorbed by the cups or hatchings. The inking device 21 includes a level monitor 24 for monitoring the level 22 of the ink in the ink supply device 21. When the ink level 22 falls below a predetermined point, the level monitor 24 transmits a low signal via the signal line 18 to the valve 19. Valve 19 opens to increase pressure P in the ink reservoir 3 so that printing ink from the ink reservoir 3 is conveyed via the supply line 4 to the ink supply device 21.

The following is true for both embodiments shown in FIGS. 1 and 2 of the ink supply devices 2 and 21: The roller 1 preferably rotates at the same circumferential speed as the form or rubber-blanket cylinders of the printing machine. The roller 1 is preferably driven by toothed gears or has its own driving motor. The ink supply devices 2 and 21 are embodied in the manner of a chamber blade, and may be easily transported without the emergence of printing ink. The ink reservoir 3 preferably has an exchangeable ink cartridge 31. The ink reservoir 3 itself can also be removed easily from the printing machine, preferably by means of a quick-release lock between the ink supply device 2, 21 and the ink reservoir 3. A non-return valve 20, which prevents ink from flowing back into the ink reservoir 3, is preferably provided in the supply line 4. The ink reservoir 3 and, with it, the ink cartridge 31, are quickly and simply exchanged by a self-closing quick-release coupling, without requiring the use of tools. To change the printing ink, the ink supply device 2 and the ink reservoir 3 are removed either jointly or separately from the printing machine, whereby no tools are needed. A new ink supply device 2 with a different printing ink is used instead, which preferably is already pre-filled with the new ink. The ink cartridges 31 for the ink reservoir 3 can be refilled at a fill station. The cartridges 31 are usually refilled with the same printing ink and need therefore be cleaned only at long time intervals. The ink supply devices 2 and 21 may also be cleaned at a cleaning station, where they are turned upside down. After the residual ink drips out, this residual ink can either be returned to the ink reservoir 3 or fed to a residual ink tank. The ink supply devices 2 and 21 are embodied in an open manner, allowing them to be cleaned in a suitable washing device.

The working pre-blade 13, the working blade 14 and the closing blade 15, respectively, may be positioned either positively or negatively on the inking device roller 1. A sensor inside the supply system for the printing ink (e.g., the level monitor 7, the pressure monitor 17 or the level monitor 24, which can be embodied as pressure sensors, conductivity sensors, capacitative sensors or ultrasound sensors, for example) ensures that an adequate ink supply is provided at all times and that, in the event of ink shortage, the ink cartridge 31 in the ink reservoir 3 is changed. The conveying roller 23 of the embodiment shown in FIG. 2, may optionally include a torque measuring device, for example, to determine if the conveying roller 23 is supplied with a sufficient quantity of printing ink at all times.

The invention includes an ink supply device 2, 21 with an ink reservoir 3 that is easily removed from the printing machine, cleanly and without tools. The ink reservoir 3 is also arranged so that it is separable from the ink supply device 2. The quantity of ink in the ink supply device 2, 21 is minimal. Therefore, at any point in time during operation, there is very little printing ink located outside of the ink reservoir 3 that could be lost during washing or cleaning. The ink reservoir 3 has an exchangeable ink cartridge 31. The printing ink is conducted under pressure from the ink reservoir 3 to the ink supply device 2, 21, and there pressed into the cups or hatchings of an inking device roller 1 via the supply line 4 by means of a pump 11 or a conveying roller 23. The ink supply device 2, 21 works with automatic refill of the ink used. When the ink is used up, the level monitor 7 sends a message to the control panel 8.

The invention is not limited by the embodiments described above which are presented as examples only but can be modified in various ways within the scope of protection defined by the appended patent claims.

We claim:

1. An inking device for supplying ink to a screen roller of a printing machine, wherein said screen roller comprises a cylinder having a longitudinal axis, a length, and a circumferential outer surface, said inking device comprising:

an ink reservoir removably mounted in the printing machine and containing a supply of stored ink;

an ink supply device mounted adjacent the screen roller in the printing machine comprising a pair of blades substantially parallel to the longitudinal axis of the screen roller, said blades sufficiently positioned with respect to the circumferential surface of the roller for sealing a section of the screen roller, said ink supply device supplying ink to the section of the screen roller sealed by the pair of blades;

a first supply line connecting said ink supply device to said ink reservoir conducting a flow of said stored ink from said ink reservoir to said ink supply device; and said ink supply device further comprising a closed system including means for carrying away ink that is not absorbed by the circumferential outer surface of the screen roller and means for supplying said ink that is not absorbed back to the section of the circumferential outer surface of the screen roller and during rotation of the screen roller.

2. The inking device of claim 1, wherein said ink supply device and said ink reservoir are connected and are detachably mounted in the printing machine such that they are removable from the printing machine as one integral piece.

3. The inking device of claim 1, wherein said ink reservoir comprises an exchangeable ink cartridge connected to said ink reservoir and a quick-release coupling holding said exchangeable ink cartridge in said ink reservoir.

4. The inking device of claim 3, further comprising a pressure source and a pressure line connecting said pressure source to said ink reservoir such that said stored ink is subjected to said pressure source for supplying said stored ink to said ink supplying device.

5. The inking device of claim 3, wherein said ink reservoir further comprises a fill level sensor generating a signal in response to a level of ink in said ink reservoir.

6. The inking device of claim 5, further comprising a display device mounted on the printing machine and connected to the fill level sensor for receiving the signal and outputting a visual indication in response to said signal.

7. The inking device of claim 4, wherein said ink reservoir comprises a cylinder and a pressurized piston connected to said pressure line, said piston exerting a pressure on said stored ink in said ink reservoir in response to a pressure in said pressure line.

8. The inking device of claim 1, further comprising a non-return valve arranged in said first supply line preventing ink from returning to said ink reservoir from said ink supplying device.

9. The inking device of claim 1, wherein said means for carrying away ink that is not absorbed comprises a pump having an input and an output and a return line connected to said pump input;

said means for supplying said ink comprises a second supply line connected between said output and the screen roller; and wherein said ink not absorbed by said screen roller is conducted through said return line to said input of said pump and is directed back toward said screen roller through said output and said second supply line.

10. The inking device of claim 7, wherein said means for carrying away ink that is not absorbed comprises a pump having an input and an output and a return line connected to said pump input;

said means for supplying said ink comprises a second supply line connected between said output and the screen roller; and wherein said ink not absorbed by said screen roller is conducted through said return line to said input of said pump and is directed back toward said screen roller through said output and said second supply line.

11. The inking device of claim 10, further comprising a pressure monitor mounted in said second supply line and an adjustable valve mounted in said pressure line, wherein said pressure monitor transmits a pressure signal to said valve and said valve opens or closes in response to said pressure signal to apply a pressure to said piston in said cylinder.

12. The inking device of claim 1, wherein said printing ink flows from said first supply line past the screen roller against a direction of rotation of the screen roller.

13. The inking device of claim 1, wherein said pair of blades comprise a working blade and a closing blade and said ink supply device further comprises a working pre-blade between said working blade and said closing blade.

14. The inking device of claim 1, wherein said means for carrying away ink that is not absorbed comprises a conveying roller for conveying said ink that is not absorbed by said screen roller to a bottom of said ink supply device and said means for supplying said ink that is not absorbed comprises said conveying roller for conveying said ink that is not absorbed from said bottom of said ink supply device back toward the screen roller.

15. The inking device of claim 7, wherein said means for carrying away ink that is not absorbed comprises a conveying roller for conveying said ink that is not absorbed by said screen roller to a bottom of said ink supply device and said means for supplying said ink that is not absorbed comprises said conveying roller for conveying said ink that is not absorbed from said bottom of said ink supply device back toward the screen roller.

16. The inking device of claim 15, further comprising a level probe mounted in said ink supply device and an adjustable valve mounted in said pressure line, wherein said level probe transmits a level signal to said valve in response to a level of ink on said bottom of said ink supply device and said valve opens or closes in response to said level signal to apply a pressure to said piston in said cylinder.

* * * * *

UNITED STATES PATENT AND TRADEMARK OFFICE

CERTIFICATE OF CORRECTION

PATENT NO. : 6,024,015

DATED : February 15, 2000

INVENTOR(S) : Peer Dilling, et al.

It is certified that error appears in the above-identified patent and that said Letters Patent is hereby corrected as shown below:

On the title page, Item [75], first inventor should read --Peer Dilling--.

Signed and Sealed this

Thirtieth Day of May, 2000

*Attest:*

Q. TODD DICKINSON

*Attesting Officer*

*Director of Patents and Trademarks*